US005511449A

United States Patent [19]

Feigenbaum

[11] Patent Number: 5,511,449

[45] Date of Patent: Apr. 30, 1996

[54] MATERIALS AND METHODS FOR PRODUCING SHOT OF VARIOUS SIZES AND COMPOSITIONS

[76] Inventor: Jeffrey J. Feigenbaum, 7339 N. Karlov Ave., Lincolnwood, Ill. 60645

[21] Appl. No.: 327,645

[22] Filed: Oct. 24, 1994

[51] Int. Cl.[6] ..... B22F 9/06

[52] U.S. Cl. ..... 75/341; 266/133

[58] Field of Search ..... 266/114, 133, 266/237; 75/331, 340, 341, 342; 264/13, 14; 222/591; 425/6, 10

[56] References Cited

U.S. PATENT DOCUMENTS

| | | | |
|---|---|---|---|
| 2,287,029 | 6/1942 | Dowdell | 83/91 |
| 2,510,574 | 6/1950 | Greenhalgh | 18/47.2 |
| 2,918,070 | 12/1959 | Carrier, Jr. | 266/133 |
| 2,978,742 | 4/1961 | Bliemeister | 18/2.4 |
| 3,060,510 | 10/1962 | Fischer et al. | 264/14 |
| 3,677,669 | 7/1972 | Bliemeister | 425/6 |
| 4,035,116 | 7/1977 | O'Brien et al. | 425/10 |
| 4,428,894 | 1/1984 | Bienvenu | 264/9 |
| 4,986,941 | 1/1991 | Hendrix et al. | 264/13 |
| 5,055,240 | 10/1991 | Lee et al. | 264/5 |
| 5,154,220 | 10/1992 | Crawford et al. | 164/270.1 |
| 5,223,185 | 6/1993 | Takei et al. | 264/14 |

FOREIGN PATENT DOCUMENTS

| | | |
|---|---|---|
| 40-13655 | 7/1965 | Japan . |

*Primary Examiner*—Scott Kastler

[57] ABSTRACT

Provided are apparatus and method for the manufacture of metallic shot for use in shotguns. The apparatus and method fractionate molten shot material within a reservoir system. Subsequent descent of the molten shot material is controlled through a temperature-regulated environment producing shot of superior sphericity and uniformity.

19 Claims, 2 Drawing Sheets

27
28
29
30
31
32
33
34
35
36
37
38
39
40
41
42
43
44
45
46
47
48
49
50
51
52
53
54
55
56
57

MATERIALS AND METHODS FOR PRODUCING SHOT OF VARIOUS SIZES AND COMPOSITIONS

FIELD OF THE INVENTION

The invention involves an apparatus and method for the manufacture of shot suitable for use, for example, with shotguns. The invention relates in general to metallurgical casting and mechanical engineering. In particular, manufacture of shot is relevant to the present invention.

BACKGROUND OF THE INVENTION

For many decades, a convenient, efficient and cost-effective means of producing shot from various metals has been sought. With the discovery that lead possesses toxic properties, the search has intensified considerably, particularly over the past three years. The provision of a cost-effective and highly efficient means for producing metal shot basically involves separating a stream of molten metal into a substantial quantity of discrete droplets per unit time, and gradually extracting the heat from those droplets. This must be done while shaping the droplets into virtually perfectly spherical bodies until they freeze, and preventing both inter-particle collisions during the freezing process and oxidation of the metal both during and after hardening. There are three basic problems to solve in doing this: (1) the molten stream of metal poured from the furnace or crucible must be separated into individual droplets of a pre-determined diameter, from which shot may be formed; (2) the heat must be extracted from the droplets of molten metal gradually and in a highly controlled manner, and (3) the latter must be done in a manner which sufficiently separates the droplets from each other so as to prevent deformations resulting from inter-particle collisions.

Existing devices have failed to find satisfactory solutions to these three basic problems. At present research laboratories are pouring thin streams of metal through heat-exchange fluids in an effort to cool the metal sufficiently to form solid shot of uniform diameter and exacting tolerances. However, with no control over the free fall of the metal through the heat exchange fluid, and lacking means to resolve the thin stream of metal into separate droplets, many of the particles in such an apparatus either fuse together prior to freezing, collide with each other in the process of freezing, or fail to freeze homogeneously. Moreover, there is little control over the diameter of the shot produced, or over the uniformity of cooling, resulting in shot of varying diameters and poor sphericity.

Several different types of shot-producing devices have been reported, such as the shot tower. It is exceedingly cumbersome, being 125–150 feet high, and requires the time, expense and inconvenience of hoisting and reheating the metal used and preparing and maintaining special housing for the apparatus. Moreover, it is limited by its inability to produce shot from any metal but lead, and is unable to generate large shot to exacting tolerances.

Alternatively, other machines, more compact than the shot tower, are relatively inefficient in production capacity over time and in percentage of shot meeting specified tolerance requirements. These devices are compact and capable of making shot from a variety of metals. However, they too are characterized by an inefficiency in production capacity and percentage of shot produced meeting specified tolerances and, in addition, are extremely complex, prone to malfunction, and are extraordinarily expensive. Moreover, virtually all of the machines listed above coat the shot metal with graphite with its attendant disadvantages of handling, and cost. Casting and oil-bath techniques are also notably lacking in efficiency and productivity, being slow and failing to yield a high percentage of large shot meeting specified tolerances. The present invention provides methods and apparatus for producing shot which overcome the above-noted deficiencies in the art.

SUMMARY OF THE INVENTION

The present invention provides an apparatus and method for the manufacture of shot. In a preferred embodiment of the invention, a method for producing shot is provided comprising the steps of: melting shot material in a crucible; pouring said shot material into a multi-tiered reservoir and fractionating said shot material into rivulets; depositing said shot material on tandem, parallel, helical tracks encased in a tube; cooling and shaping the molten shot material into spherical discrete quanta as the material travels down the tracks. At the bottom of the tracks, the shot material falls off the tracks to the bottom of the tube. In turn, the shot material selectively exits the tube through covered holes in the bottom. Also provided are apparatus for producing shot according to the above-described method.

Also in a preferred embodiment, shot material for use in methods or apparatus of the invention is selected from the group consisting of pure metals and alloys.

Also in a preferred embodiment, methods and apparatus of the invention comprise a binary system of reservoirs. Entrance and exit orifices of both reservoirs are preferably designed to reduce the flow of molten shot material in order to facilitate its fractionation into discrete quanta to enable the formation of individual shot particles.

Also in a preferred embodiment, methods and apparatus according to the invention comprise at least one helical track; wherein the track is selected from the group consisting of metals with melting points no less than 350 degrees Celsius.

Also in a preferred embodiment, the helical tracks are concave from a superior perspective.

Also in a preferred embodiment, the helical tracks are tandem and adjacent.

In a preferred apparatus according to the invention, the rate of migration of the shot material is controlled through maintenance of a designed pressure head in the reservoir system, reservoir orifice design, defined track slopes, impediments to the transit of shot material placed in the helical tracks and the viscosity of the heat exchange fluid. Additionally, thermal gradients facilitate the controlled formation of spherical shot of uniform size.

DETAILED DESCRIPTION OF THE INVENTION

The present invention is the first to offer a cost-effective, simple, compact, and highly productive means of producing shot of virtually any metal or metal alloy with a melting point of 350° C. or less, having a uniform diameter of up to 12 mm or more, and meeting high tolerance criteria. In fact, the present invention offers a 50–100 fold cost savings over known existing devices.

The present invention enables the mass production of metal shot, in a manner providing many advantages over the prior art, among them being the production of metal shot: 1) Exhibiting uniform diameter over a wide range of possible diameters, from 0.25 millimeters (mm) to greater than 12 mm with only relatively minor, simple adjustments required to vary the shot size; 2) Composed of not only lead which is relatively easy to produce, but also of bismuth, tin, cadmium, and any alloys thereof, and other metals having a melting point at or below 350° C. (if the cylindrical tank in which the shot is produced is made of a material more resistant to extremes of heat than transparent borosilicate glass (for example, copper, iron, or aluminum), the present device may be used to make shot of metals with melting points above 350° C. as well); 3) Manufactured to very exacting tolerances; 4) Lacking any graphite or similar coating; 5) Using a compact, inexpensive apparatus approximately 3 feet×4 feet in area and 6 feet in height; and 6) Featuring an elegance and simplicity of design.

Thus, in an area little more than 15 feet wide by 5 feet long, and for comparatively little cost, over 11 million pieces of shot could be made per week to very exacting tolerances in an average 8 hour, 5 day work week (with the tonnage varying with the size of the shot produced). The processing cost per unit would only minimally exceed the cost of the metal itself and the costs of melting the metal and maintaining it in a molten state prior to the production of the shot.

Figure 1A:
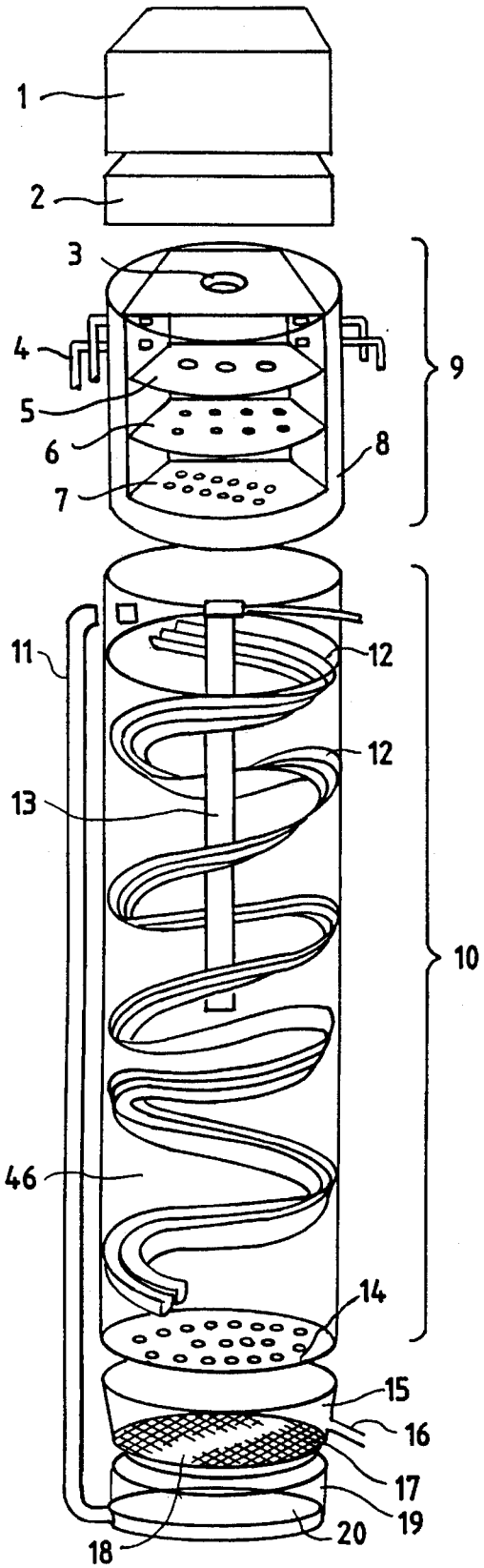
FIG. 1*a* shows an apparatus for producing shot according to the invention.
Figure 1B:
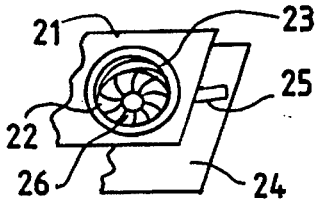
FIG. 1*b* illustrates the iris diaphragm regulating the diameter of the holes in the reservoir plates used in an apparatus according to the invention.
Figure 1C:
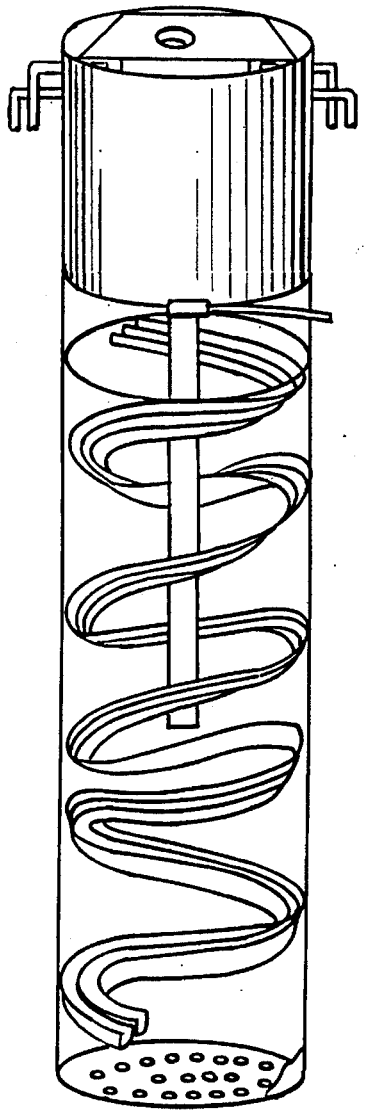
FIG. 1*c* illustrates the reservoir and cylindrical borosilicate glass tank of an apparatus according to the invention.

In a preferred embodiment, the invention consists of six principal parts, each of which is described below. The pans, identified in accordance with FIGS. 1*a*, 1*b*, and 1*c*, are presented in general order of their appearance in the apparatus from its uppermost aspect, downward.

EXAMPLE 1

Figure 2:
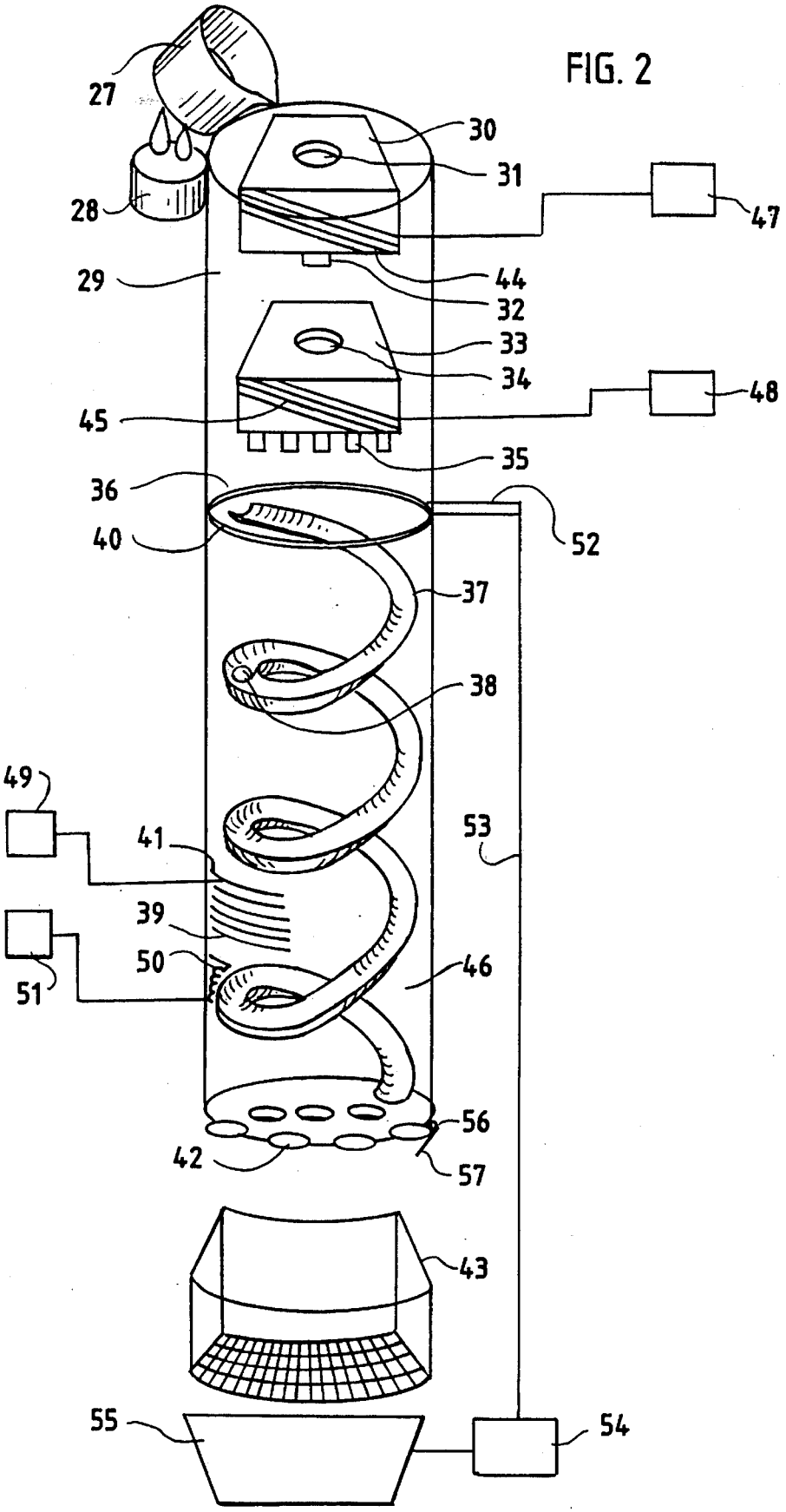
FIG. 2 illustrates another apparatus for the manufacture of shot in accordance with the invention.

A crucible 1 contains a metal with a melting point of 350° C. or less, including lead, bismuth, tin, cadmium, and alloys comprising any combination of these or other metals. The crucible may be attached to the apparatus or may be separate from the apparatus. The metal is rendered into a molten state by a heating element or turnace 2 positioned adjacent to the crucible. The molten metal is then delivered, for example by pouring, directly onto a track 12 and, preferably to a reservoir system, which may preferably be a multi-tiered reservoir 9 situated within a hollow heat-insulated cylinder 8 containing heat-insulating material such as fiber glass, or clad in heat-insulating material. The reservoir 9 contains three heat-conducting aluminum plates 5, 6, and 7, which divide the reservoir into three tiers or chambers. The three heat-conducting aluminum plates 5, 6, 7, preferably comprise orifices of reduced diameter as one proceeds from plate 5 to plate 7. The reservoir system may optionally comprise a primary reservoir 30 and secondary reservoir 33 as shown in FIG. 2. Resistance wire placed beneath each plate maintains the molten state of the metal within each chamber. The choice of resistance wire depends on the heat required to melt the particular shot material employed, as is understood by the ordinary artisan in the field. The molten metal enters the reservoir 9 as a molten stream through a large orifice 3 in the top of the reservoir and passes into the first tier or chamber (the receiving chamber 5 which is the uppermost of the three chambers). The pressure head within the reservoir can be controlled by adjusting the volume of molten metal within the receiving chamber. This is effected by opening or closing valves within the overflow tubes 4 just above the desired height of molten metal within the chamber. The invention comprehends one or more overflow tubes. The more overflow tubes employed, moreover, the greater will be the flexibility in setting the desired pressure head. From the floor of the receiving chamber 5 or first tier, the molten metal exits as rivulets to the middle tier 6. The interstices or orifices within the floor of each chamber comprise openings 26 defined by iris diaphragms 22 regulated manually (or optionally by pre-set heat transducers) by means of a lever 25. The iris is surrounded by a metal collar 23 and is sandwiched between two plates (top-plate 21 and underplate 24).

As the molten metal cascades down in rivulets from the receiving chamber 5 to the middle chamber 6, it is increasingly fractionated until rendered into individual droplets. The molten metal falls from the orifices within the droplet-generating (bottom) chamber 7 into a transparent, cylindrical tank 10, said tank 10 optionally housing one or more helical and concave (when viewed from above) tracks 12. Apparatus comprising more than one track 12 have said tracks arranged adjacent and parallel to each other. For purposes of preventing inter-particle collisions, a flow rate of molten metal is preferably set by adjusting valves in the overflow tubes 4, to a droplet rate of one every 1.3 seconds or 46 droplets per minute from each of 20 orifices. The tank 10, comprising a cylindrical borosilicate glass tube, for example, Pyrex™, Duran™, or Kimax, is open at its superior end and capable of articulation with the reservoir thereby, as illustrated in FIG. 1*c*. The tank 10 may contain a heat transfer or heat exchange fluid 46. The viscosity of the heat exchange fluid is preferably between 4.91 and 1800 cps at 23° C. For example, the invention comprehends that the following heat exchange fluids may be used in methods and apparatus of the invention: a diphenyl oxide/biphenyl blend [Dowtherm A™]; a mixture of di- and tri-aryl ethers [Dowtherm G™]; partially hydrogenated terphenyl [Dowtherm HT™] or alternatively, a polysiloxane heat transfer fluid [e.g. Syltherm 800™]. Since the viscosity of the heat exchange fluid is one factor determining the rate of descent of the shot material, the choice of heat exchange fluid will depend on the type of shot to be produced, as is understood by one of skill in the art. The tank 10 also optionally comprises a quartz immersion heater 13; preferably single tube, single phase, 240 volt, 6000 watt, 30" heated length, with helical tracks 12 spiraling down and around the heater 13. The helical tracks 12 are made of aluminum or a similar tractable, heat conducting metal having a high melting point (350° C. or above). An additional or alternative means of maintaining such a gradient consists of the optional use of resistance wire powered by an autotransformer, rheostat, or other power source, positioned under the aluminum helical track.

Upon entering the helical tracks 12, the droplets proceed downward under the force of gravity, being concomitantly cooled and shaped into virtually perfect spheres as they roll down the tracks. The initial slope of the helical tracks initiates the prompt descent of the droplets down the track after their dropping onto the track. Due to the presence of a temperature gradient at or slightly above the melting point of the metal, the droplets are in a highly plastic form, and hence not vulnerable to permanent deformation upon falling into and rolling down the tracks. Since the droplet is shaped as it rolls and the temperature gradient produces a gradual diminution of temperature, the droplet gradually cools as it descends, with its sphericity concomitantly established as it nears the bottom of the track. The rate of cooling (or heat extraction by the heat-transfer fluid) is therefore a function of the rate of descent. The latter is regulated by controlling the grade of the downward slopes, by the insertion of low-grade upward slopes, and by the viscosity of the heat-transfer fluid. All three combine to reduce its rate of descent relative to free-fall acceleration to the point of enabling the rate of cooling to be virtually pre-determined.

Upon reaching the bottom of the tracks, the shot particles are completely spherical and solidified and are close to room temperature, which they fully attain upon falling to the bottom of the tank. The shot particles subsequently enter and pass through holes 14 in the bottom of the tank. On the exterior surface of the bottom of the tank 10, square rubber lids are utilized to cover the holes. In one embodiment, the lids are pressed tightly against the underside of the tank 10 glass by a tightly coiled spring-hinge assembly bonded to the glass, and the edges of the lids are tapered or chamfered to form a semi-seal with the underside of the tank 10 around each covered hole. As shot particles accumulate over the covered holes, their cumulative weight forces open the lids and the particles exit the tank 10 thereby. The shot particles exiting the tank 10 enter a shot-collecting chamber 15 located immediately below the bottom of the tank. Immediately following the transit of the shot particle, the lid shuts tightly again until the process is repeated with the passage of subsequent shot particles.

Also in an embodiment of the invention, the tank 10 may comprise a hollow cylinder lacking tracks 12. In such an embodiment, it is preferred that the tank 10 contain an heat exchange fluid 46.

Once in the shot-collecting chamber 15, the shot particles roll through conduits in the walls 16 and onto conveyor belts, with the residual oil passing through a screen at the bottom of the chamber 17 and optionally through a fluid-cleansing filter 18, into the fluid-collecting chamber 19 which collects the heat-transfer fluid 20. A pump (e.g., a Viking C-32 pump, approximately 3 cubic inches, 0.5 horsepower, 1150 revolutions per minute, 115 Volts single phase generating 2 pounds per square inch of pressure) returns the heat-exchange fluid to the cylindrical glass tank 10, preferably at the rate of 0.25 gallons per minute, through a 0.5 inch diameter heat-insulated conduit tube 11. Optionally, resistance wire powered by a rheostat may be used to encircle the fluid-collecting chamber 19 and heat it, for example, to within 50° C. of the melting point of the metal prior to its recycling.

A preferred embodiment of the instant invention is also illustrated in Example 2.

EXAMPLE 2

The apparatus used is illustrated in FIG. 2. Metal was deposited in the crucible 27 for rendering into a molten state. The metals that may be used in this apparatus are limited by the upper limits of the temperatures which may be attained by the propane, or other gas, or electric furnace 28, applying heat to the metal without affecting the integrity of either the heat exchange fluid 46 or the transparent borosilicate glass tube 39. This heat is applied to the crucible 27 and sustained by the heating elements in the primary 30 and secondary 33 reservoirs, and those around and/or within the transparent borosilicate glass tube 39. For these reasons, conventional steel could not be used as the shot material, nor could aluminum (the latter being the material of which the spiral track 37 within the transparent borosilicate glass tube 39 is composed). However, lead, bismuth, cadmium, tin, their alloys, and other metals having a melting point at or below 350° C. could be used. In this example, the borosilicate glass tube 39 was about 6 inches in diameter and about 4 feet in length. The insulated hollow cylinder 29 had a diameter of about 6 inches and a length of approximately 1.5 feet. The primary 30 and secondary 33 reservoirs each had diameters of about 6 inches.

Once melted, the metal was poured into the primary reservoir 30, the amount poured in pounds per second being critical as a constant pressure head had to be maintained. For shot size of approximately 1 millimeter in diameter, about 1 pound per second of molten shot material being delivered was found to be appropriate. If shot diameters of about 6 millimeters in diameter is desired, the shot material should be delivered at a rate of about 10 pounds per second. The molten metal left the primary reservoir through an exit orifice 32 in the middle of the bottom side and fell 2.0–2.5 inches from the primary reservoir 30 into the secondary reservoir 33. Both reservoirs were contained within a large hollow cylinder 29 having an inner diameter slightly larger than that of the two reservoirs. The hollow cylinder 29 was filled with air, although a gas promoting nucleation, such as helium, to which the molten metal was exposed as it passed from the primary 30 to the secondary reservoir 33, could have been used. Once inside the secondary reservoir 33, the metal passed through one of several holes 35, preferably 4 holes 35 with a device of these dimensions, in the bottom of the reservoir 33. In doing so, the molten metal stream was broken up, and the pressure head exerted on the metal passing through each hole 35 was diminished relative to that present in the primary reservoir 30, by an extent commensurate with the number of holes 35 in the secondary reservoir 33. A semicircular spiral track 37 was provided beneath each hole 35 and upon exiting an orifice 35 in the bottom of the secondary reservoir 33, the metal dropped 0.50–3.00 inches onto track 37 and commenced to roll down the track 37. Less preferably, the holes 35 could be situated directly above a single spiral track 37. Approximately 1.5–2.0 feet from the top of the track 37, convex speed bumps 38 could have been placed at 1.5–2 inch intervals within each track 37, serving to impede travel of the shot material and break the metal up into discrete quanta. Beyond these bumps 38, the individual metal quanta would then roll down the track 37, as in this example, forming solid spheroids as they gradually cooled, as described below. The invention also comprehends embodiments lacking speed bumps in the helical track or tracks. Also comprehended are embodiments lacking the helical track or tracks.

The hollow cylinder 29 containing the primary 30 and secondary 33 reservoirs extended 0.5–3.00 inches beyond the bottom of the secondary reservoir 33 to the top 40 of the transparent borosilicate glass tube 39 containing the aforementioned semicircular aluminum spiral tracks 37, articulated with the superior end or top rim 40 of the transparent borosilicate glass tube 39 by making direct contact. Alternatively, the lower rim 36 of the insulated hollow cylinder 29 could have been articulated with the transparent borosilicate glass tube 39 by a press fit with the hollow cylinder 29 extending around the outer circumference of the transparent borosilicate glass tube 39 for about 1–3 inches below the top of the transparent borosilicate glass tube 39. The transparent borosilicate glass tube 39 was filled with a heat exchange fluid 46, and contained a temperature gradient, the topmost aspect of the fluid 46 being maintained about 0°–10° C. below the melting point of the metal, with the temperature of the heat-exchange fluid 46 gradually lowered along the length of the track 37 as the metal rolled to the bottom of the track 37 where the temperature was maintained at about ambient room temperature.

Thus, as the metal separated within the secondary reservoir 33 and rolled down the track 37, it gradually cooled, the rate of cooling being a function of the fall time through the heat exchange fluid 46. The latter was adjusted according to the heat exchange properties of bismuth, the particular metal used, by 1) varying the slope of the spiral track 37 (less slope retarding acceleration and more slope enhancing it, and 2) varying the viscosity of the heat exchange fluid 46 used, with the most viscous heat-exchange fluid available allowing significantly less acceleration relative to the least viscous fluid.

As the solid shot fell to the bottom of the transparent borosilicate glass tube 39, the metal was removed through holes 42 appearing at the bottom of the transparent borosilicate glass tube 39, the holes 42 being suitable for shot expulsion since their diameters were slightly greater than the diameter of the shot being formed. Covering the holes 42 were spring 30-controlled circular doors 57 forming seals with temperature-resistant sealing grommets. As the shot fell to the bottom of the transparent borosilicate glass tube 39, it collectively forced open the circular doors and passed through one of the holes 42 exiting into a collecting bin with a fine screen mesh 43 at the bottom to collect the shot. Periodic removal of accumulated material from the fine screen mesh 43 permitted continuous collection of shot. As shot was being continually formed, the holes 42 were continually filled with shot, preventing any appreciable loss of heat exchange fluid 46 from the transparent borosilicate glass tube 39. The fluid 46 that did escape the transparent borosilicate glass tube 39 was collected in a receptacle 55 and was recycled continuously through use of heat resistant tubing 53 and a pump 54, for example, Viking Pump Model C-32. The fluid recycled per unit time was negligible in comparison to the bed volume of heat exchange fluid 46 and did not appreciably affect the thermal gradient.

What is claimed is:

1. An apparatus for the manufacture of shot comprising:

a binary reservoir system capable of altering a flow of molten shot material comprising a primary reservoir with a single exit orifice and a secondary reservoir located below said primary reservoir, said secondary reservoir having a plurality of exit orifices, each of said exit orifices of said secondary reservoir having a diameter less than that of said single exit orifice in said primary reservoir;

a tube wrapped with resistance wire located below and adjacent said binary reservoir system, said tube having a plurality of orifices suitable for shot expulsion at an end of said tube distal from said reservoir system, each of said orifices being covered on its exterior by a rubber lid;

one or more helical tracks disposed in said tube; and means for capturing shot expelled from said apparatus on a continuous basis.

2. The apparatus according to claim 1 further comprising means for impeding the flow of shot material through said one or more helical tracks.

3. The apparatus according to claim 1 wherein said one or more helical tracks is made from material selected from the group consisting of metals with melting points greater than 350 degrees Celsius.

4. The apparatus according to claim 1 wherein said one or more helical tracks is semicircular in cross-section.

5. The apparatus according to claim 1 wherein said one or more helical tracks is U-shaped in cross-section.

6. The apparatus according to claim 1 wherein said helical tracks are disposed in a parallel and adjacent orientation.

7. The apparatus according to claim 1 wherein said tube contains a heat exchange fluid.

8. The apparatus according to claim 1, further comprising:

a crucible capable of containing a quantity of shot material; and a furnace capable of melting shot material having a melting temperature of 350 degrees Celsius or less.

9. An apparatus according to claim 1 wherein the rubber lids are spring-hinged.

10. The apparatus according to claim 1 wherein said single exit orifice of said primary reservoir has a diameter of between about 0.03 inches and about 0.1 inches.

11. The apparatus according to claim 1 wherein said reservoir system is disposed in an insulated hollow cylinder.

12. The apparatus according to claim 3 wherein said one or more helical tracks is made from aluminum.

13. An apparatus for the manufacture of shot comprising:

a reservoir system for altering a flow of molten metal into droplets comprising at least two reservoirs, each reservoir having at least one exit orifice;

a tube disposed below and adjacent said reservoir system, said tube containing heat exchange fluid and one or more helical tracks, wherein said droplets are formed before entering said heat exchange fluid; and heating means associated with said tube for imparting a temperature gradient to said heat exchange fluid.

14. The apparatus according to claim 13 wherein said reservoir system comprises a primary reservoir with a single exit orifice, and a secondary reservoir located below said primary reservoir, said secondary reservoir having a plurality of exit orifices, each of said orifices in said secondary reservoir having a diameter less than said exit orifice in said primary reservoir.

15. The apparatus according to claim 14 wherein said exit orifice in said primary reservoir has a diameter of between about 0.03 inches and about 0.1 inches.

16. The apparatus according to claim 13 wherein said one or more helical tracks have impeding means for impeding the flow of shot material along said tracks.

17. The apparatus according to claim 16 wherein said impeding means are convex bumps on said one or more helical tracks.

18. The apparatus according to claim 13 wherein said at least one orifice in said primary reservoir and said at least one orifice in said secondary reservoir are defined by iris diaphragms, wherein said iris diaphragms are surrounded by a metal collar and are disposed between a top plate and a bottom plate.

19. A method for the manufacture of shot comprising the steps of:

melting shot material;

producing droplets by flowing molten shot material through a reservoir system comprising a primary reservoir with a single exit orifice and a secondary reservoir located below said primary reservoir, said secondary reservoir having a plurality of exit orifices, each of said exit orifices of said secondary reservoir having a diameter less than that of said single exit orifice in said primary reservoir;

providing a heat exchange fluid contained in a tube located below and adjacent said reservoir system;

imparting a thermal gradient to said heat exchange fluid;

providing at least one helical track disposed in said tube;

guiding said droplets through said heat exchange fluid by supporting said droplets on said at least one helical track disposed in said tube; and collecting shot formed thereby.

* * * * *